US010337843B1

(12) United States Patent
Kinzer

(10) Patent No.: US 10,337,843 B1
(45) Date of Patent: Jul. 2, 2019

(54) BROADHEAD WITH ROTATING BLADES

(71) Applicant: Kye Kinzer, Las Cruces, NM (US)

(72) Inventor: Kye Kinzer, Las Cruces, NM (US)

( * ) Notice: Subject to any disclaimer, the term of this patent is extended or adjusted under 35 U.S.C. 154(b) by 0 days.

(21) Appl. No.: 15/942,222

(22) Filed: Mar. 30, 2018

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | | |
|---|---|---|---|---|
| 5,172,916 | A | 12/1992 | Puckett | |
| 5,458,341 | A | 10/1995 | Forrest et al. | |
| 5,879,252 | A | 3/1999 | Johnson | |
| 6,322,464 | B1 | 11/2001 | Sestak | |
| 7,311,622 | B1 * | 12/2007 | Futtere | F42B 6/08 473/583 |
| 7,377,869 | B2 | 5/2008 | Wohlfeil et al. | |
| 8,021,251 | B1 * | 9/2011 | Ward | F42B 6/08 473/583 |
| 8,062,155 | B2 | 11/2011 | Butcher | |
| 8,113,974 | B1 * | 2/2012 | Ward, Jr. | F42B 6/08 473/583 |
| 8,133,138 | B1 * | 3/2012 | Hannah | F42B 6/08 473/583 |
| 9,303,963 | B1 | 4/2016 | Ford | |
| 9,803,963 | B1 * | 10/2017 | Huang | F42B 6/08 |
| 2010/0113196 | A1 * | 5/2010 | Jones | F42B 6/08 473/583 |
| 2010/0173734 | A1 * | 7/2010 | Robbins | F42B 6/08 473/584 |

* cited by examiner

*Primary Examiner* — John A Ricci
(74) *Attorney, Agent, or Firm* — Law Office of Jeff Williams PLLC; J. Oliver Williams

(57) ABSTRACT

A broadhead assembly for use with an arrow shaft includes a main body, a blade assembly, and an attachment member. The main body has a central axis and a mating surface for coupling to the arrow shaft. The blade assembly rotatably couples to the main body, and is oriented so as to rotate radially to the central axis. The blade assembly has a blade axis of rotation. The attachment member is coupled to the main body and configured to secure the blade assembly in a closed orientation. Rotation of the blades within the blade assembly is such that they rotate about the blade axis and the blade axis is parallel to the central axis.

18 Claims, 11 Drawing Sheets

BROADHEAD WITH ROTATING BLADES

BACKGROUND

1. Field of the Invention

The present application relates to archery equipment, and more particularly to broadhead hunting tips for arrows having a plurality of rotating blades.

2. Description of Related Art

Present tips used in arrow hunting typically include a single rigid member having one or more cutting edges. The cutting edges are sharpened to cut into an animal or other target upon impact. The head or tip of the rigid member may be relatively narrow or may be broadened away from the shaft of the arrow to increase the size of the impact zone on the target. An example may include ferrule heads or tips. In such an instance, each tip is one singular rigid member.

More recently, various designs have been made to increase the size of the tip to cause more damage. The concept of an increase in size is designed to occur at impact, therefore the pre-impact form of the tip is compact while the post-impact form is expanded. This expanded form is useful to ensure a quick kill of the animal thereby not requiring a second shot. These tips are designed with rotating blades that are tucked or hidden internally within the tip. They are traditionally stored with the tip forward of the point of rotation, such that a line between the tip of the rotating blade and the point of rotation is fairly concentric/parallel with the axis of the arrow shaft. Unfortunately, upon impact, this configuration generates increased axial forces upon the rotating blades that can be relatively high resulting in a decreased speed of the arrow tip as a whole at impact.

Additionally, this same configuration requires the rotating blade to have a large sweeping area. This sweeping motion moves the blade from a first retracted position past a second fully perpendicular position to the shaft, and finally to a third more streamlined final position. In the third position, the tip location is closer to the shaft than in the second fully perpendicular position. Transitioning between the second and third position decreases the relative size and cutting impact of the blades on the animal before being locked into its final third position.

Furthermore, the relative speed of the rotating blades to the animal upon impact is drastically smaller than the arrow tip itself during deployment. The rotating blades are designed to deploy upon impact and flare outward. The axis of rotation is relatively perpendicular to the shaft of the arrow resulting in the blades having a sweeping motion parallel to the plane of the rotating blade and that of the axis of the arrow shaft. Although in principle, this design appears adequate, the large sweeping motion of the rotating blades results in increased deployment time and slower relative rotating blade tip speeds immediately after impact. A slower relative speed can lead to decrease cutting effectiveness of the rotating blades.

In operation, these blades are secured in the first retracted and compact configuration with one or more bands. These bands are held in slots around the body of the tip and become dislodged when impact occurs to allow the moving blades to do their sweeping motion. Bands are difficult because they can wear out or become lost after impact. Additionally, these bands are required to keep the blades retracted and if the user runs out of bands, the arrow tip cannot be used as it will not fly correctly with unsecured blades.

Although strides have been made to provide a tip for an arrow, considerable shortcomings remain. It is desired that an improved broadhead be provided that allows for the use of rotating blades but eliminates the disadvantages of the present designs.

SUMMARY OF THE INVENTION

It is an object of the present application to provide a broadhead with rotating blades having a main body coupled to an arrow shaft, a blade assembly rotatably coupled to the main body, and an attachment member configured to selectively restrict movement of the blade assembly. The blade assembly of the present application is configured to rotate relative to the main body at impact. The axis of rotation is parallel or concentric with that of the arrow shaft. Upon impact, the blade assemblies rotate radially about an axis parallel with the arrow shaft. This manner of rotation ensures that the relative blade area only expands after impact and does not thereafter shrink or retract to a smaller size. Blade area is maximized.

It is a further object of the present application to provide a blade assembly configuration that minimizes axial forces upon impact. The blades of each blade assembly are forward facing the entire time and remain so during deployment. By keeping the cutting surface forward at all times, the axial forces are minimized at impact.

A further object of the present application is to maximize the relative speed of the broadhead to the target or animal it impacts. Rotation of the blades radially about a blade axis parallel to the shaft axis prevents the sweeping motion common in blades that rotate along the length of the shaft. By having a parallel blade assembly axis to that of the shaft axis, the relative velocity of the rotating blades during deployment remains consistent with the velocity of the main body.

Another object of the present application is the beveling of the rotating blade surface to induce movement and rotation of the blades at impact. The angle of beveling can also assist in flight characteristics as the blades are fully exposed. The blades are held to the main body by a reusable attachment member, such as a magnet. The attachment member is fully reusable and internally located to improve aerodynamics during flight.

It is a further object to provide a blade assembly that generates torque through its geometry in relation to the arrow shaft. The forward movement of the blade through the target causes an opening or lift force on the blade axis of rotation. This lift force is generated by at least one or more of the following conditions: (1) a backward swept blade edge (strait or curved) that is non co-planar with the axis of rotation of the blade assembly; (2) a beveled blade edge that is co-planar with the axis of rotation of the blade assembly wherein the angled bevel on the leading edge causes rotation of the blade assembly upon impact; and (3) a blade surface that is contoured or twisted similar to that of a propeller wherein impact induces rotation about the axis of rotation of the blade assembly.

Ultimately the invention may take many embodiments and is not limited to the particular embodiments shown herein. The broadhead assembly of the present application overcomes the disadvantages inherent in the prior art.

The more important features of the assembly have thus been outlined in order that the more detailed description that follows may be better understood and to ensure that the present contribution to the art is appreciated. Additional features of the assembly will be described hereinafter and will form the subject matter of the claims that follow.

Many objects of the present assembly will appear from the following description and appended claims, reference being made to the accompanying drawings forming a part of this specification wherein like reference characters designate corresponding parts in the several views.

Before explaining at least one embodiment of the assembly in detail, it is to be understood that the assembly is not limited in its application to the details of construction and the arrangements of the components set forth in the following description or illustrated in the drawings. The assembly is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the various purposes of the present system. It is important, therefore, that the claims be regarded as including such equivalent constructions insofar as they do not depart from the spirit and scope of the present assembly.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
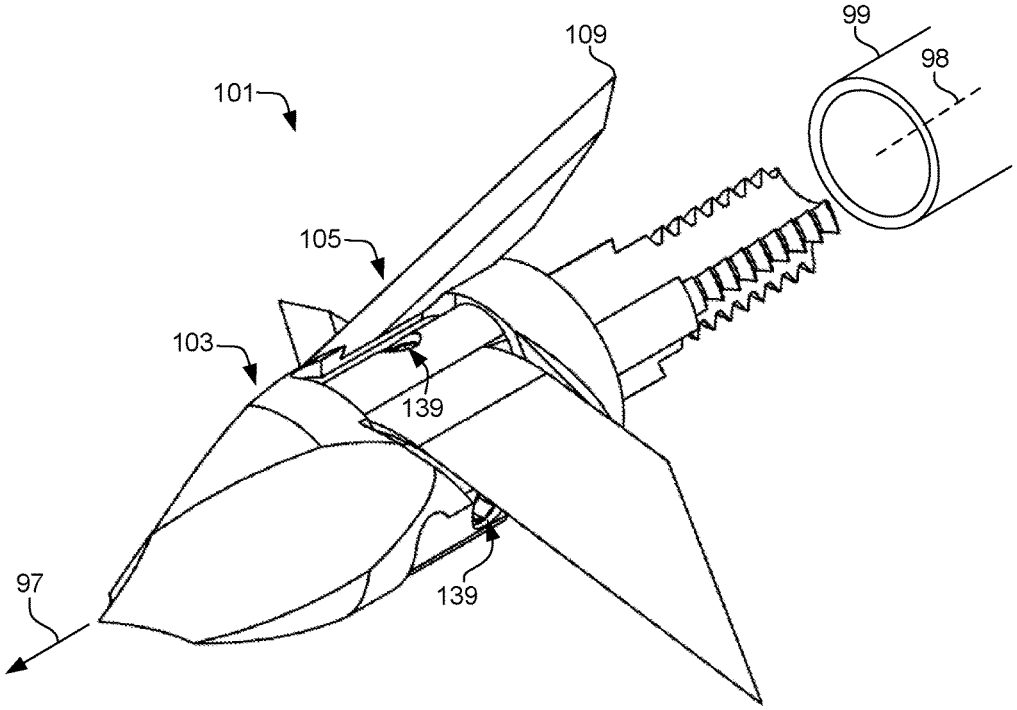
FIG. 1 is a front perspective view of a broadhead assembly with rotating blade assemblies according to an embodiment of the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the assembly described herein may be oriented in any desired direction.

The assembly and method in accordance with the present application overcomes one or more of the above-discussed problems commonly associated with existing broadheads with rotating blades. In particular, the assembly is configured to maintain the full relative velocity of the rotating blades, maximize the full cutting area of the blades, and minimize axial forces upon impact. The broadhead assembly of the present application is configured to deploy rotating blades from the main body in a manner that allows the rotating blades to rotate along an axis concentric to that of the arrow shaft axis and axis of the main body. These and other unique features of the assembly are discussed below and illustrated in the accompanying drawings.

The assembly and method will be understood, both as to its structure and operation, from the accompanying drawings, taken in conjunction with the accompanying description. Several embodiments of the assembly may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The assembly and method of the present application is illustrated in the associated drawings. The assembly includes a main body configured to couple to the an arrow shaft. The main body includes a plurality of cavities for the locating of a plurality of blade assemblies. The blade assemblies are aligned with the axis of the main body and are configured to rotate circumferentially around a blade axis that is parallel to the axis of the main body. An attachment member is included to secure the rotating blades in a closed position prior to impact. The attachment member is reusable and remains coupled to the main body. Additional features and functions of the device are illustrated and discussed below.

Referring now to the Figures wherein like reference characters identify corresponding or similar elements in form and function throughout the several views. The following Figures describe the assembly of the present application and its associated features. With reference now to the Figures, an embodiment of the modular observation assembly and method of use are herein described. It should be noted that the articles "a", "an", and "the", as used in this specification, include plural referents unless the content clearly dictates otherwise.

Figure 2:
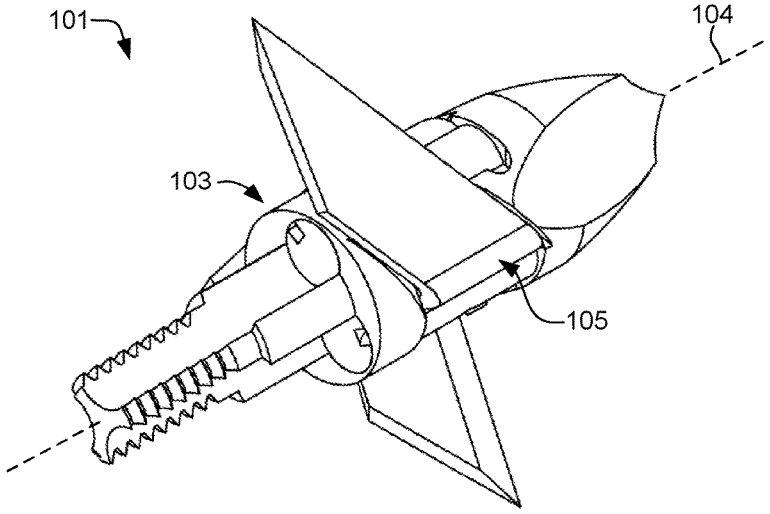
FIG. 2 is a rear perspective view of the broadhead assembly of FIG. 1.

Referring now to FIGS. 1-4 in the drawings, assorted perspective views of a broadhead assembly 101 with rotating blades is illustrated. FIGS. 1 and 2 illustrate assembly 101 with the blades in a closed orientation, wherein FIG. 1 is a front perspective view and FIG. 2 is a rear perspective view. Assembly 101 is configured to couple to an arrow shaft 99 and be propelled through the air in a set forward trajectory 97. Assembly 101 includes a main body 103, a blade assembly 105, and an attachment member 107 (see FIG. 4). Main body 103 defines a central axis 104. Blade assembly 105 includes blades that deploy radially or circumferentially about shaft 99.

Figure 3:
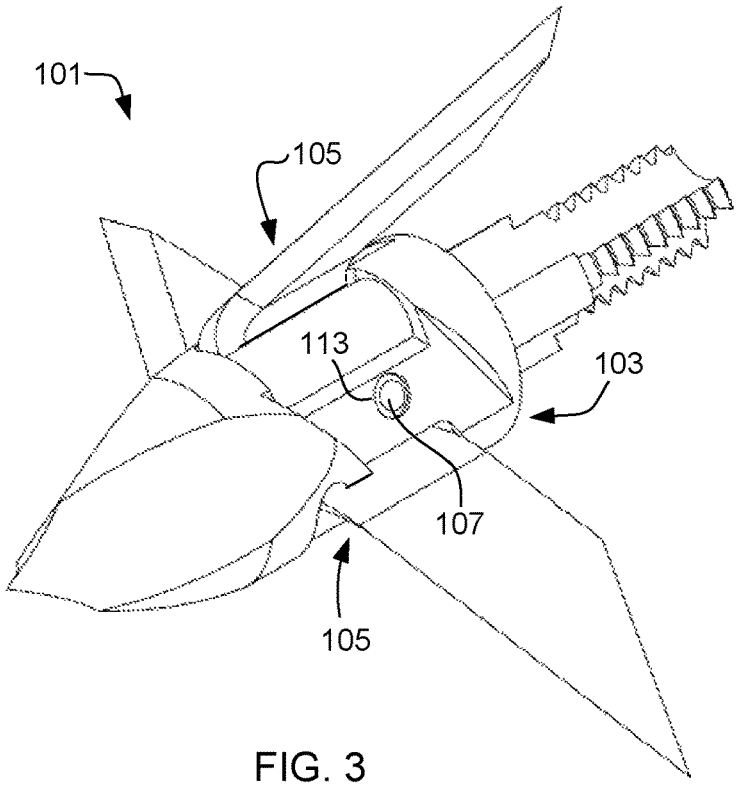
FIG. 3 is a front perspective view of the broadhead assembly of FIG. 1 with rotating blade assemblies in an open position.

Blade assembly 105 is configured to rotate about main body 103 upon impact of assembly 101 with a target, such as an animal. Upon impact, blade assembly 105 contacts the target and begins the transition from the closed orientation to that of an open orientation. As see in FIGS. 3 and 4, blade assemblies 105 are illustrated in the open orientation. FIG. 3 is a front perspective view of assembly 101 and FIG. 4 is a rear perspective view of assembly 101.

Figure 4:
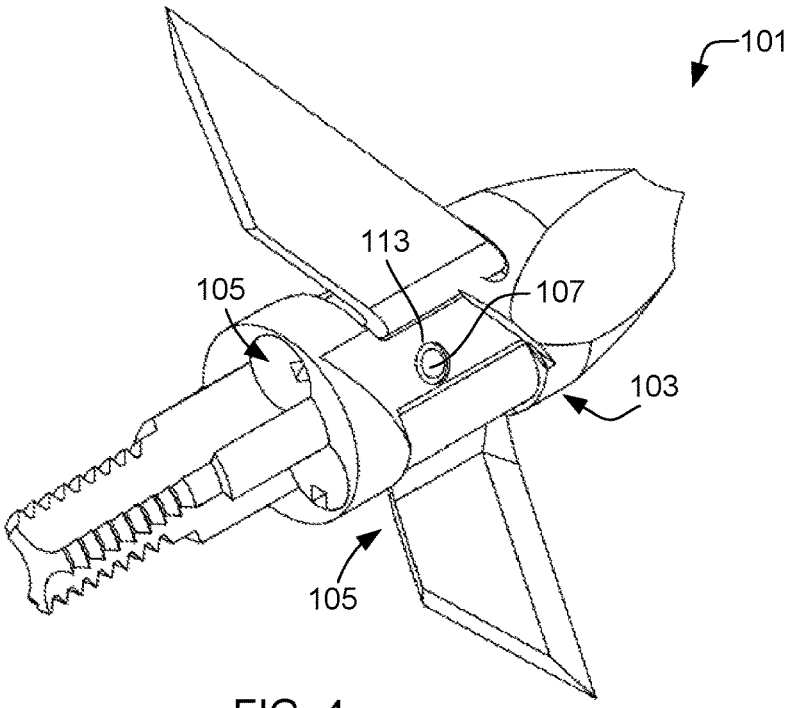
FIG. 4 is a rear perspective view of the broadhead assembly of FIG. 2 with the rotating blade assemblies in an open position.

In both FIGS. 3 and 4, blade assemblies 105 are rotated into an open orientation as compared with FIGS. 1 and 2. Rotational movement is done radially/circumferentially about an axis parallel to axis 104. In these figures it is possible to see attachment member 107. Member 107 is configured to secure blade assemblies 105 in the closed orientation. The closed orientation is held prior to impact. Member 107 is coupled to main body 103 between blade assemblies 105 and main body 103. Main body 103 includes an aperture 113 for the locating of member 107. Member 107 may be secured within aperture 113 via any known bonding and attachment methods, such as magnetic.

It is preferred that member 107 operate with blade assembly 105 without adhesives or mechanical fasteners, although such methods are within the scope of the present application. Ideally, member 107 is a magnet which is configured to magnetically attract a portion of blade assembly 105. Its strength can be selected so as to release when exposed to impact forces upon the target. During use, member 107 remains firmly coupled to main body 103 upon impact. As it is internally located within aperture 113, passage of assembly 101 through the target does not act to dislodge or pull it away from main body 103. The position/location of member 107 and the use of magnetic force allows member 107 to be reusable. There is no concern for running out of supplies or damage from impact.

Figure 5:
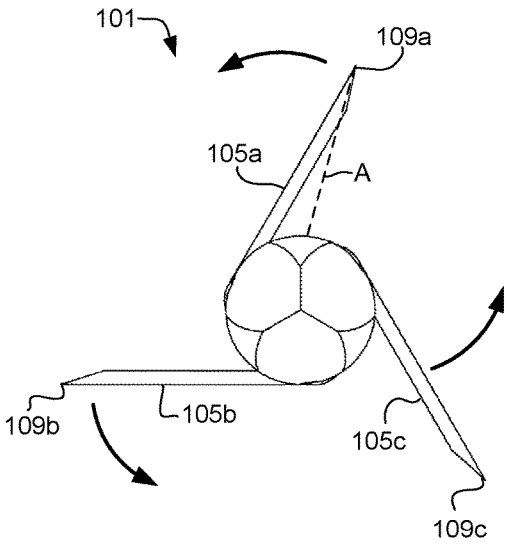
FIG. 5 is a front view of the broadhead assembly of FIG. 1.
Figure 6:
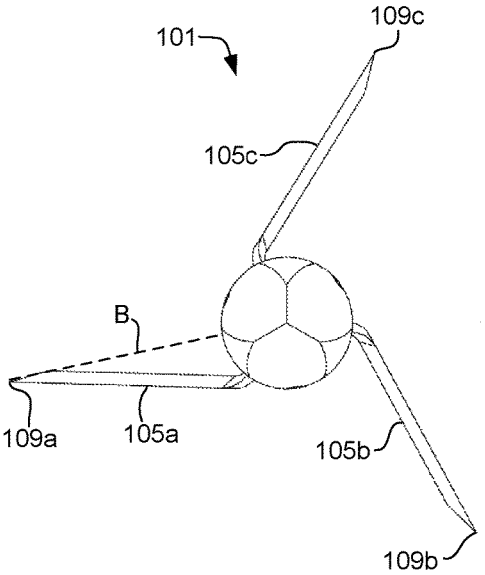
FIG. 6 is a front view of the broadhead assembly of FIG. 5 with the rotating blade assemblies rotated to an open orientation.
Figure 7:
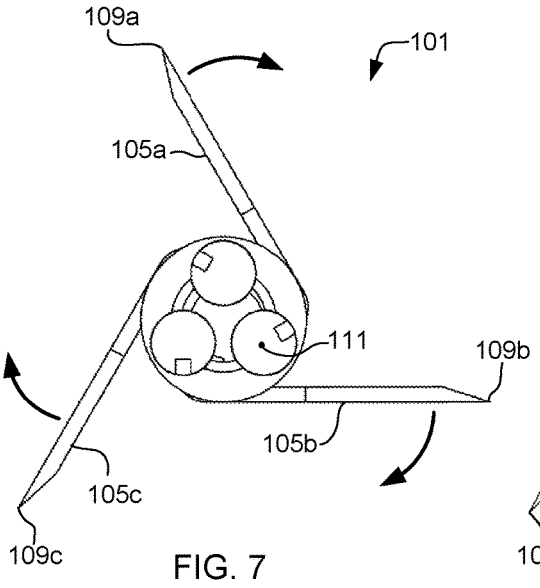
FIG. 7 is a rear view of the broadhead assembly of FIG. 1.
Figure 8:
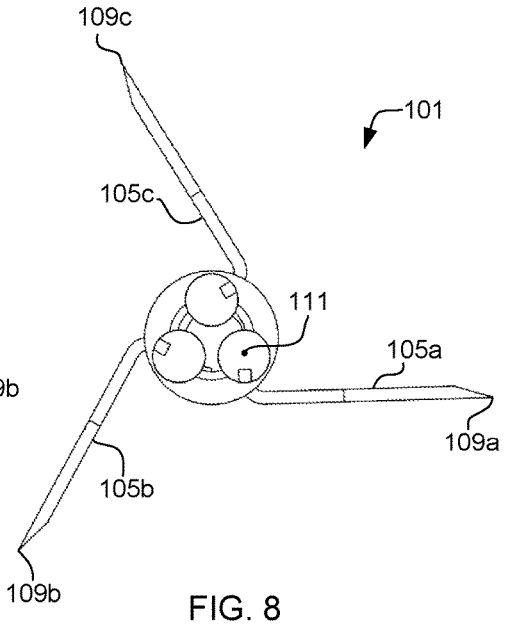
FIG. 8 is a rear view of the broadhead assembly of FIG. 7 with the rotating blade assemblies rotated to an open orientation.

Referring now also to FIG. 5-8 in the drawings, front and rear views of assembly 101 are illustrated. These views are useful to illustrate the manner in which each blade assembly 105 rotates. FIGS. 5 and 6 show a front view of assembly 101 with the blade assemblies closed and open, respectively. Likewise, FIGS. 7 and 8 show a rear view of assembly 101 with the blade assemblies closed and opened, respectively. As depicted, assembly 101 includes three rotating blade assemblies 105, namely assemblies 105*a*, 105*b*, and 105*c*. It is understood that assembly 101 may include more or less than three.

Each blade assembly 105 includes a blade tip 109, namely blade tips 109*a*, 109*b*, 109*c*, defined as the outer most distal point of the blade assembly from main body 103. In the closed orientations (see FIGS. 5 and 7) the distance between blade tip 109*a* and main body 103 is defined by distance A. In the open orientations (see FIGS. 6 and 8) the distance between blade tip 109*a* and main body 103 is defined by distance B. Distance B is greater than Distance A. In fact, the rotational alignment of assemblies 105 are such that during rotation of blade assemblies 105 from the closed orientation to the open orientation, the distance between the blade tips 109*a*, 109*b*, 109*c* and main body 103 only increase in size. This is because the rotation of blade assemblies 105 are done about a blade axis 111 which is parallel to that of central axis 104. Central axis 104 is also configured to be concentric with that of shaft axis 98 of shaft 99. This parallel alignment allows the blade assemblies to rotate in a circumferential radial manner relative to shaft axis 98 as opposed to a longitudinal radial manner where rotation travels along the length of shaft 99. Another way to reference the alignment of blade axis 111 is to compare it to trajectory 97. Blade axis 111 is aligned to be parallel with the flight trajectory 97 of main body 103.

Although it has been stated that blade axis 111 is parallel to central axis 104, it is understood that some embodiments may make them not parallel wherein blade axis 111 is aligned inward within 10 degrees of central axis 104. In these embodiments, the forward most portion of blade assembly 105 may be closer to central axis 104 than the rear most portion (i.e. portion closest to shaft 99). Both inward and outward alignment is possible. Additionally, both downward and upward alignment of assembly 105 as a whole are possible. The blades may also be aligned within varied amount of degrees from being parallel with axis 104.

Figure 9:
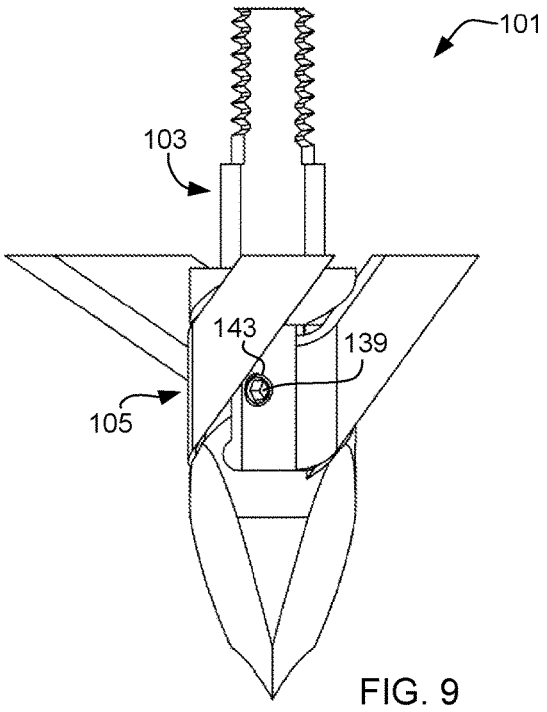
FIG. 9 is a top view of the broadhead assembly of FIG. 1.
Figure 10:
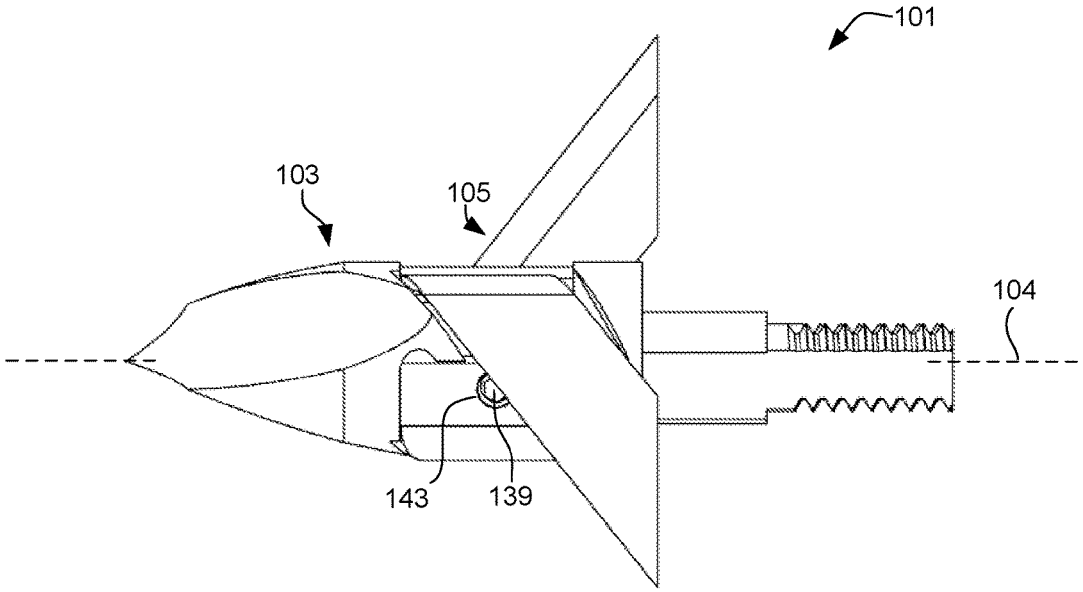
FIG. 10 is a side view of the broadhead assembly of FIG. 1.

Referring now also to FIGS. 9 and 10 in the drawings, a top view and a side view of assembly 101 is illustrated with the blade assemblies 105 in a closed orientation. In these figures it is not possible to see attachment member 107 as member 107 is configured to secure blade assemblies 105 in the closed orientation.

Figure 11:
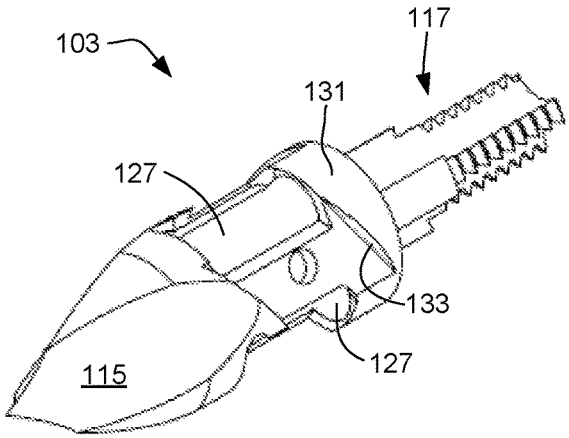
FIG. 11 is a front perspective view of a main body of the broadhead assembly of FIG. 1.
Figure 12:
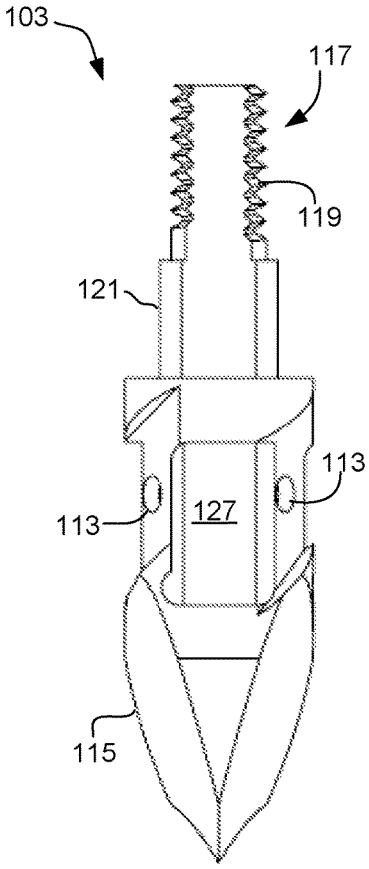
FIG. 12 is a top view of the main body of FIG. 11.
Figure 13:
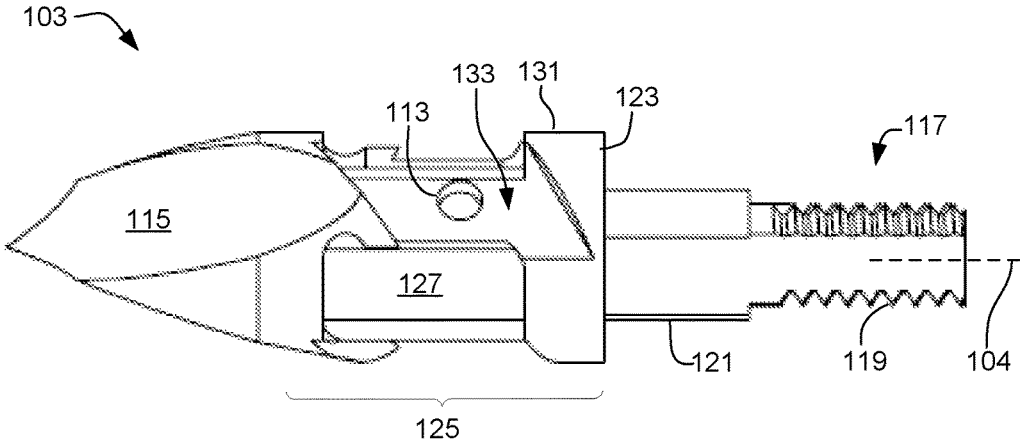
FIG. 13 is a side view of the main body of FIG. 11.

Referring now also to FIGS. 11-13 in the drawings, assorted views of main body 103 are illustrated. FIG. 11 illustrates a front perspective view of main body 103. Main body 103 includes a main tip 115 configured to be sharpened to facilitate clean entry into a target. Main body 103 also includes a base portion 117 opposite that of main tip 115. Base portion 117 is configured to mate with shaft 99. One possible method of accomplishing this is wherein base portion 117 includes a threaded section 119 configured to match with corresponding threads in shaft 99. Additionally, base portion 117 includes a body shaft 121. When mated, shaft 99 passes over threaded section 119 and body shaft 121. Shaft 99 may contact face 123.

Figure 14:
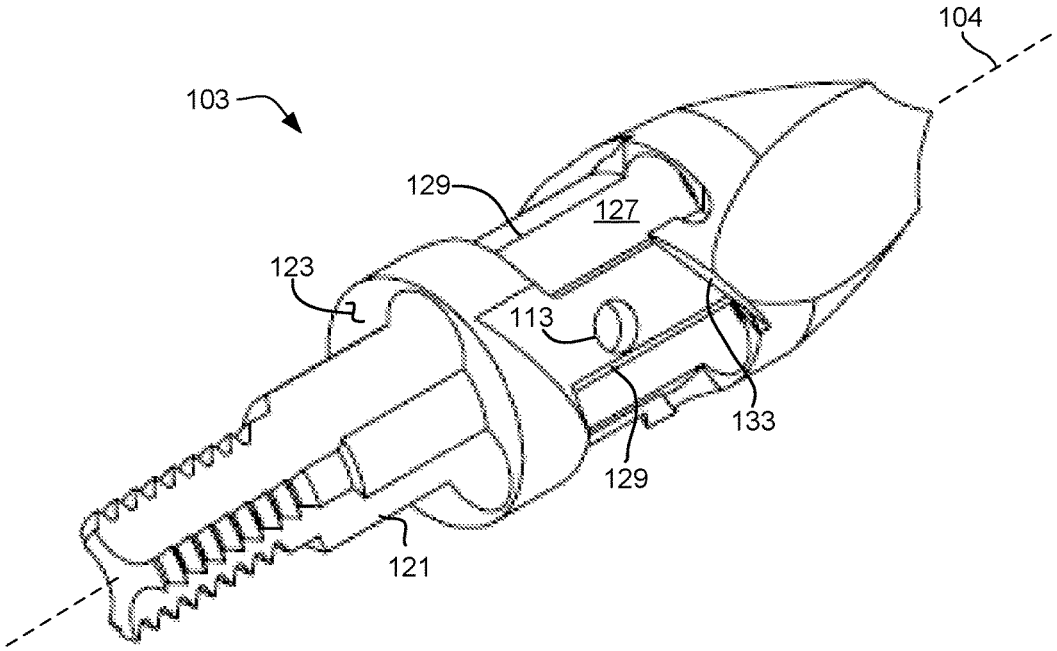
FIG. 14 is a rear perspective view of the main body of FIG. 11.
Figure 15:
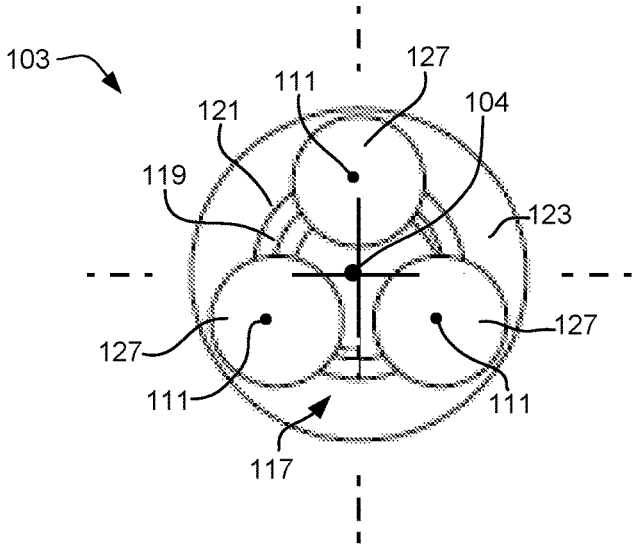
FIG. 15 is a rear view of the main body of FIG. 11.
Figure 16:
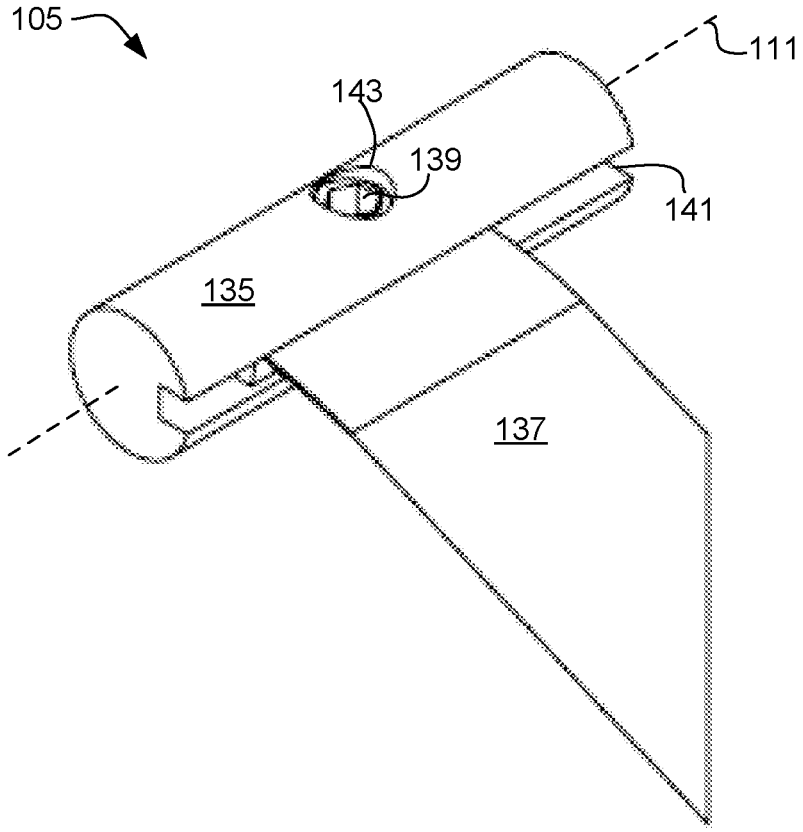
FIG. 16 is a front perspective view of the rotating blade assembly of FIG. 1.
Figure 17:
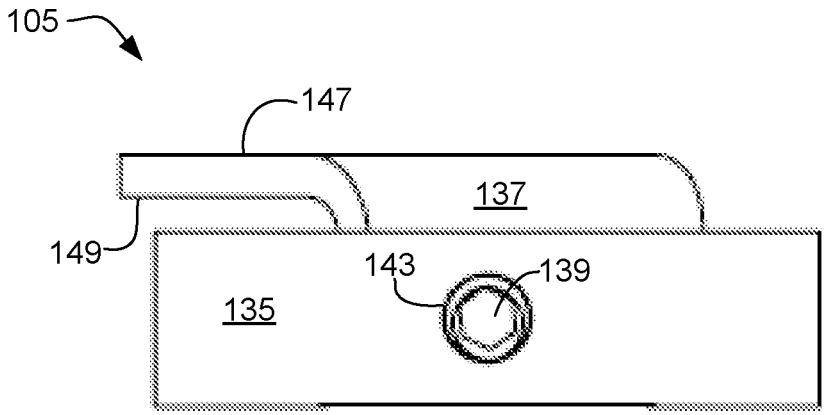
FIG. 17 is a side view of the rotating blade assembly of FIG. 16.
Figure 18:
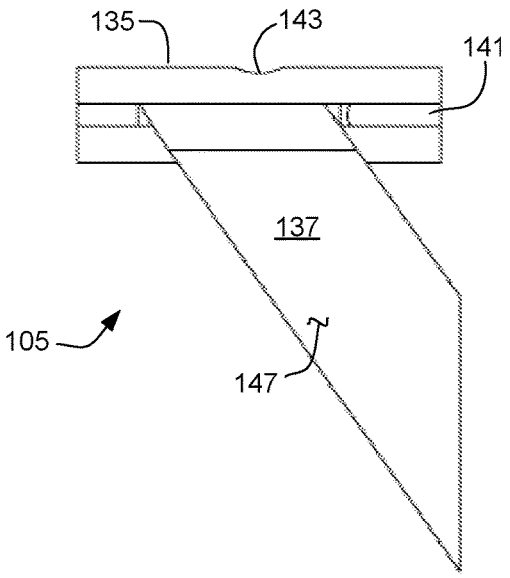
FIG. 18 is a top view of the rotating blade assembly of FIG. 16.

Referring now also to FIGS. 14 and 15 in the drawings, a rear perspective view and rear view of main body 103 is illustrated. Main body 103 includes a central portion 125 (as seen in FIG. 13) located between main tip 115 and base portion 117. Central portion 125 is configured to house a portion of blade assembly 105. Main body 103 includes a cavity 127. Each cavity 127 is axially aligned with central axis 104. The number of cavities 127 are radially spaced around central axis 104 (see FIG. 10).

Central portion 125 includes a cutout 129 passing from surface 131 of central portion 125 to cavity 127. Due to the radial alignment of cavities 127 around central axis 104 and the corresponding cutouts 129, narrow strips of material separate each cutout 129 from each other. Aperture 113 is formed in this strip of material section. Aperture 113 does not pass through into cavity 127. Member 107 is configured to be exposed within a groove 133 as seen in particular with FIGS. 3 and 4. Groove 133 is configured as an indent within central portion 125 to allow for the slight recess of blade assembly 105 when in the closed orientation.

Referring now also to FIGS. 16-20 in the drawings, assorted views of the rotating blade assembly 105 are illustrated. Rotating blade assembly 105 includes a cylindrical shaft 135, a blade 137, and pin 139. As noted previously, a key feature of blade assembly 105 is the ability to rotate circumferentially about axis 104 at impact. This rotation occurs as a result of some characteristics of assembly 105. A torque needs to be applied to blade 137 at impact to induce rotational movement about axis 111. In some ways this may be done through the use of a beveled edge. It is understood a beveled edge may assist in torque generation. Other characteristics of blade 137 that provides a torque about axis 111 is the swept or drafted nature of the blades. Blades 137 have a profile that sweeps backward to along the direction of flight toward the tip of the blade. This profile can assist in rotational movement of assembly 105 at impact. Another more prominent generator of rotational movement (torque) is the fact that the blade is not planar with axis 111. By offsetting the blade from axis 111, impact on a target across the blade will cause the blade to act as a lever arm which in turn provides torque about axis 111. The distance between the plane of the blade 137 and axis 111 can affect the amount of torque generated at impact.

Cylindrical shaft 135 is an elongated cylindrical part that is configured to translate within cavity 127. Shaft 135 rotates freely within cavity 127 and is secured in place at least partially by the placement of shaft 99 adjacent face 123. Blade axis 111 is concentric to the axis of cavity 127. As seen in the drawings, the shape of cavities 127 are formed into base portion 117.

Shaft 135 includes a slot 141 for the reception of blade 137. Shaft 135 also includes aperture 143 (see also FIGS. 9 and 10). Aperture 143 passes through at least one side of shaft 135 and slot 141. Aperture 143 may pass through any portion of the other side of slot 141 in shaft 135. Pin 139 is configured to pass through aperture 143 and a portion of blade 137. Various methods may be used to secure pin 139 in place, such as interference fit, adhesives, and so forth. Pin 139 is removable to permit for the interchanging of blades 137. While shaft 135 is in cavity 127, access to pin 139 may be restricted. In some embodiments, manual rotation of each blade assembly 105 may permit selective access. This allows for the interchanging of blades 137 while shaft 135 remains within cavity 127. It is understood that there are multiple methods of assembling or interchanging blades 137 and assembly 105. Alternate embodiments may select to prevent interchanging of blades 137. The depicted design serves as a singular exemplary manner of operation only.

Figure 19:
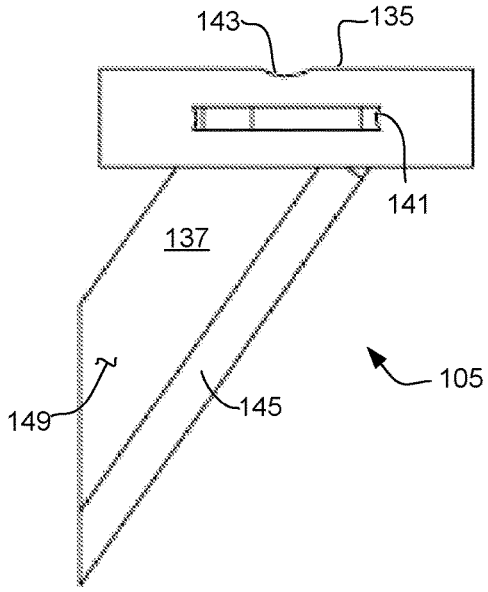
FIG. 19 is a bottom view of the rotating blade assembly of FIG. 16.
Figure 20:
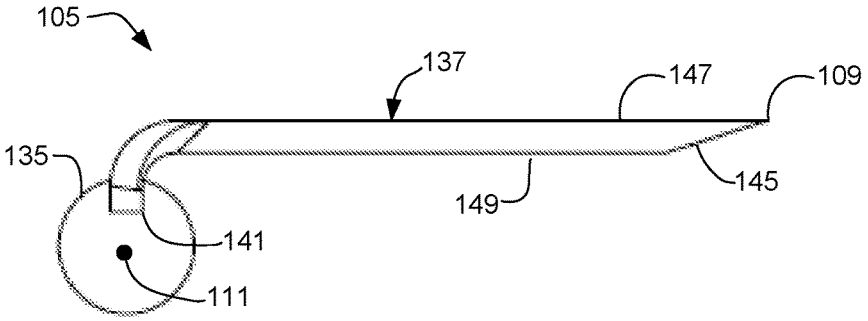
FIG. 20 is a front view of the rotating blade assembly of FIG. 16.

As seen in particular in FIGS. 19 and 20, blade 137 includes a beveled surface 145 configured to face forward into the path of trajectory 97 at all times. Although a single bevel is shown, it is understood that blade 137 may include one or more bevels. The beveled surface 145 is exposed externally to main body 103 when blade assembly 105 is in the closed and open orientations. Blade 137 and beveled surface 145 may help to influence flight characteristics of assembly 101 so as to improve trajectory. Upon impact, beveled surface 145 penetrates the target and induces an upward force against surface 149 of blade 137 so as to automatically move blade 137 to an open orientation.

Blade 137 is configured to rest within groove 133 when blade assembly 105 is closed. Blade 137 passes through cutouts 129 and into slot 141. Rotation between the open and closed orientations occurs as blade 137 rotates between the edges of cutouts 129. Furthermore, as seen in FIGS. 16-20, blade 137 defines a plane across surface 147. The plane defined by surface 147 is parallel to blade axis 111. Or in other words, the direction of rotation of blade 137 is perpendicular to the plane of blade 137 defined by surface 147.

Figure 21:
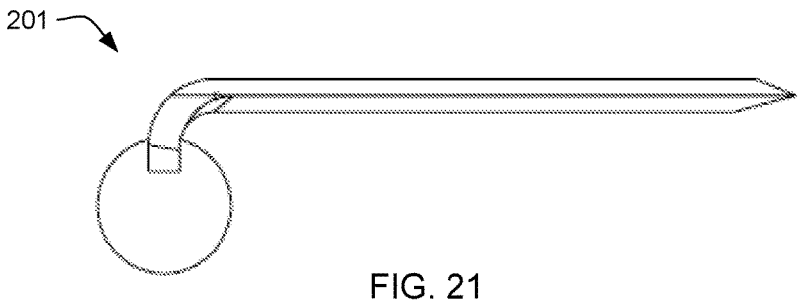
FIGS. 21-34 are side and perspective views of alternate embodiments of the rotating blade assembly of FIG. 16.
Figure 22:
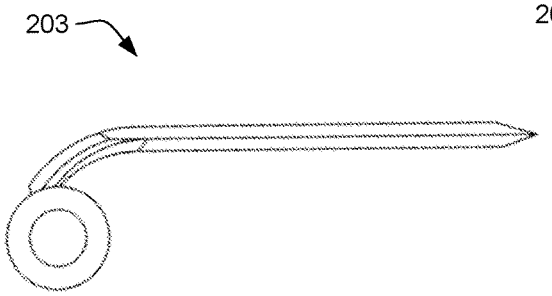
Figure 23:
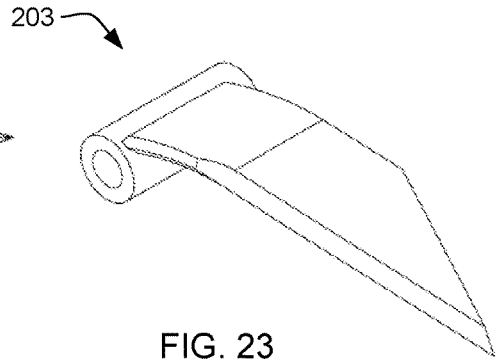
Figure 24:
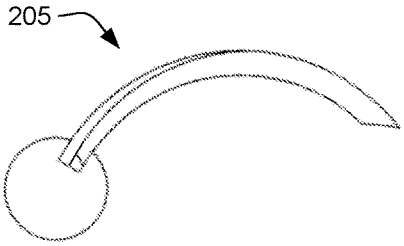
Figure 25:
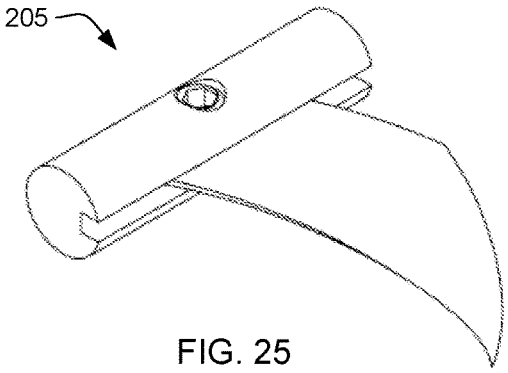
Figure 26:
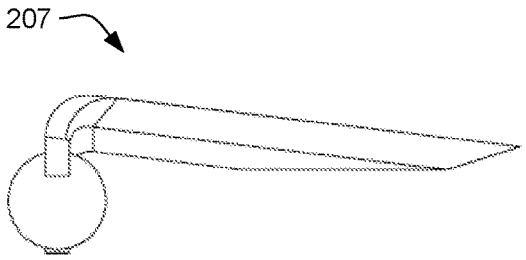
Figure 27:
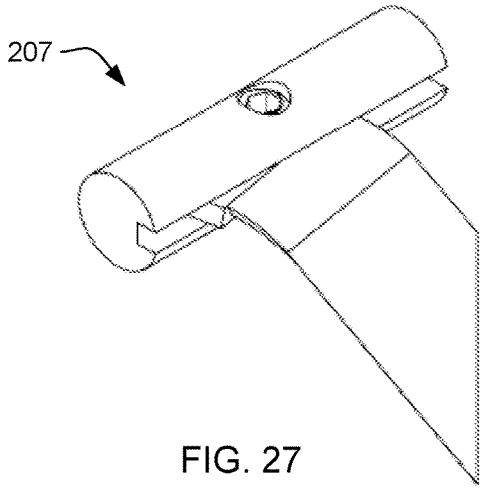
Figure 28:
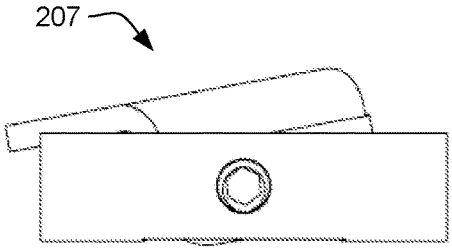
Figure 29:
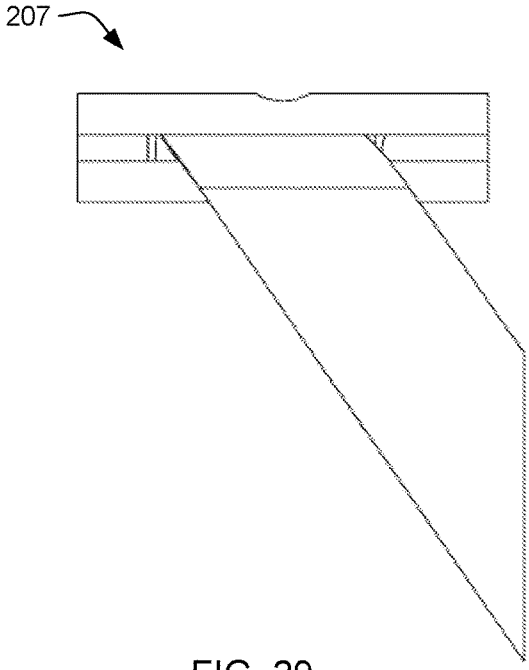
Figure 30:
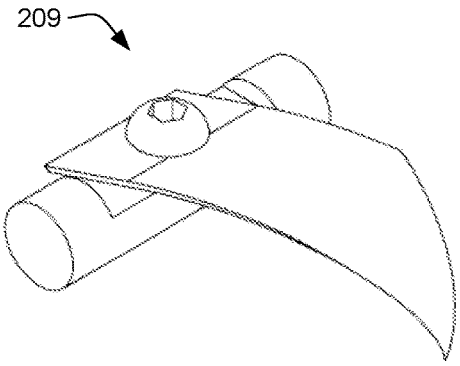
Figure 31:
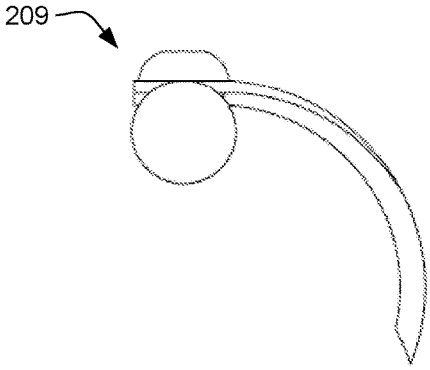
Figure 32:
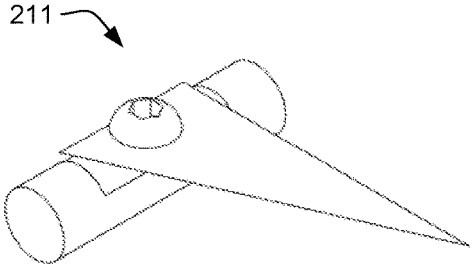
Figure 33:
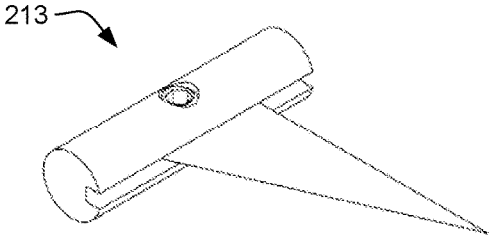
Figure 34:
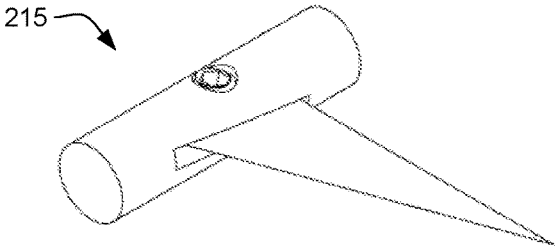

Referring now also to FIGS. 21-34 in the drawings, assorted views of alternate embodiments of rotating blade assembly 105 is illustrated. The blade assemblies 201-215 depicted in these figures are similar in form and function to blade assembly 105. Much like blade 137, the blades of assemblies 201-215 provide a blade that is swept or drafted rearward to the path of trajectory as the blade extends away from the rotating cylindrical shaft. As with blade 137, the swept profile helps to induce a lift of the blade at impact which can induce rotation of the cylindrical shaft. Additionally, the embodiments predominantly are elevated or offset from the axis of the corresponding shaft. In FIG. 21 an alternate embodiment of assembly 105 is illustrated wherein the blade includes a dual beveled leading edge. In FIGS. 22 and 23, blade assembly 203 is illustrated wherein a dual beveled edge is maintained but the blade is pinned or coupled to the shaft in a different manner. In FIGS. 24 and 25, blade assembly 205 is illustrated wherein a circular concentric single bevel is used on the blade. In FIGS. 26-29, assembly 207 is illustrated wherein the blade is pivoted backward in relation to the cylindrical shaft as well as being pivoted upward as seen in FIG. 28 specifically wherein the leading edge is elevated in comparison to the trailing edge. In FIGS. 30 and 31, assembly 209 is illustrated wherein the blade is attached at the top of the cylindrical shaft and includes an eccentric circular form with a single beveled edge. FIG. 32 is similar to assembly 209 but assembly 211 includes a strait angled centric form with a single beveled edge. Assembly 213 of FIG. 33 has a blade similar to the one used in assembly 211 but the blade is centrally located through a slot in the cylindrical shaft. Assembly 215 of FIG. 34 depicts a straight centric blade that is angled rearward with a single beveled edge. The blade of assembly 215 is pivoted to elevate the leading edge above the trailing edge of the blade. As seen through FIGS. 21-34, blade assembly 105 may take different shapes and alignments and still accomplish the task of inducing rotational movement about the axis 111 on impact. It is understood that other shapes and alignments are possible and that these alternate embodiments are only exemplary of a few different types. Adjustment of beveled edges, variations of leading and trailing edge heights, offsets of the blade from the axis of the cylindrical shaft, and the profile of the blade are all factors that influence the degree or amount of torque generated at impact. Other factors can exist to influence torque generation aside from those listed.

The current application has many advantages over the prior art including at least the following: (1) radial deployment of the blades circumferentially around a blade axis which is parallel with the shaft axis as opposed to being perpendicular to the shaft axis; (2) maintaining of equal relative velocity of the entire broadhead assembly during impact and deployment of the blades; (3) reusable attachment members; (4) consistent increase in cutting size during deployment without shrinkage; (5) the use of a sharp blade edge to induce an upward force upon the blade and thereby facilitating rotation upon impact; (6) no rotation of the blade along the length of the shaft axis results in more minimal blades; and (7) parallel blade axis with the shaft axis results in retention of blades in a closed position upon initial release from the bow.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A broadhead assembly, comprising:

a main body having a central axis and a mating surface for coupling to an arrow shaft;

a blade assembly rotatably coupled to the main body, the blade assembly oriented so as to rotate radially about a blade axis of rotation, the blade axis of rotation being aligned with the central axis, the blade assembly includes a cylindrical shaft and a blade, the cylindrical shaft rotating about the blade axis of rotation, the blade passes through a slot in the cylindrical shaft; and an attachment member coupled to the main body and configured to secure the blade assembly in a closed orientation.

2. The assembly of claim 1, wherein the main body includes a cavity for locating a portion of the blade assembly.

3. The assembly of claim 2, wherein the blade assembly is configured to rotate within the cavity.

4. The assembly of claim 1, wherein the blade assembly further includes a pin configured to pass through an aperture in the cylindrical shaft and a portion of the blade so as to secure the blade to the cylindrical shaft.

5. The assembly of claim 4, wherein the blade can be interchanged from the cylindrical shaft while the cylindrical shaft remains in communication with the main body.

6. The assembly of claim 1, wherein the blade includes a beveled surface facing forward.

7. The assembly of claim 6, wherein the beveled surface is exposed externally to the main body when the blade assembly is in the closed orientation.

8. The assembly of claim 1, wherein the blade assembly includes a blade having a blade tip, the blade assembly operates between the closed orientation and an open orientation, the open orientation being when the blade assembly is rotated about the blade axis of rotation so as to expand the distance between blade tip and the main body.

9. The assembly of claim 8, wherein the blade tip only increases in distance between the blade tip and the main body as the blade assembly rotates from the closed orientation to the open orientation.

10. The assembly of claim 1, wherein the blade assembly includes a blade defining a plane, the plane being parallel to the blade axis.

11. The assembly of claim 1, wherein the blade assembly includes a blade defining a plane, the direction of rotation of the blade being perpendicular to the plane of the blade.

12. The assembly of claim 1, wherein the blade axis is aligned within 10 degrees of the central axis.

13. The assembly of claim 1, wherein the blade axis is aligned to be parallel with a flight trajectory of the main body.

14. The assembly of claim 1, wherein the blade axis of rotation is parallel to the central axis.

15. The assembly of claim 1, wherein the central axis is concentric to a shaft axis.

16. The assembly of claim 1, wherein the attachment member is reusable.

17. The assembly of claim 1, wherein the attachment member is a magnet configured to magnetically attract a portion of the blade assembly so as to maintain the closed orientation.

18. The assembly of claim 1, wherein the attachment member remains affixed to the main body as the blade assembly transitions between the closed orientation and an open orientation.

* * * * *